US005542480A

United States Patent [19]

Owen et al.

[11] Patent Number: 5,542,480

[45] Date of Patent: Aug. 6, 1996

[54] PERFORATING GUN WITH RETRIEVABLE MOUNTING STRIPS

[75] Inventors: Harrold D. Owen, Fort Worth; David S. Wesson, Waxahachie, both of Tex.

[73] Assignee: Owen Oil Tools, Inc., Fort Worth, Tex.

[21] Appl. No.: 372,393

[22] Filed: Dec. 8, 1994

[51] Int. Cl.[6] ..... E21B 43/116; E21B 43/119

[52] U.S. Cl. ..... 175/4.51; 175/4.6; 166/55; 102/310; 102/321

[58] Field of Search ..... 175/4.6, 4.51; 166/55.1, 55; 102/310, 319, 321

[56] References Cited

U.S. PATENT DOCUMENTS

| | | | |
|---|---|---|---|
| 4,312,273 | 1/1982 | Camp | 175/4.6 X |
| 4,326,462 | 4/1982 | Garcia et al. | 175/4.6 X |
| 4,523,650 | 6/1985 | Sehnert et al. | 102/310 X |
| 4,543,703 | 10/1985 | Wetzel et al. | 102/310 X |
| 4,598,775 | 7/1986 | Vann et al. | 175/4.6 |
| 4,681,037 | 7/1987 | Regalbuto | 102/310 |
| 4,694,754 | 9/1987 | Dines et al. | 102/310 |
| 4,753,301 | 6/1988 | Berry | 175/4.6 |
| 4,771,827 | 9/1988 | Barker et al. | 166/55.1 |
| 4,951,744 | 8/1990 | Rytlewski . | |
| 5,095,999 | 3/1992 | Markel . | |
| 5,241,891 | 9/1993 | Hayes et al. . | |

*Primary Examiner*—Frank Tsay
*Attorney, Agent, or Firm*—Robert A. Felsman

[57] ABSTRACT

A longitudinally slotted carrier having one end adapted for mounting on a tubing string, the carrier being nonplanar, with a slotted configuration and interior dimensions to enable capsule charge orientation at selected phases between 0 and 360 degrees. The carrier has a frangible seam that fractures upon detonation to form two retrievable strips, each supported by the tubing string for retrieval. The seam is a narrow bridge, formed by slotting the carrier, with a cross sectional area that shatters upon detonation of the shaped charges. The remaining cross sectional area of each strip is sufficient to assure retrieval after detonation. The strips are nonplanar, arcuate or a segment of a circle in cross section. When the capsule charges are arrayed around many phases, by attaching both from and rear portions of the capsule charges to the unslotted regions of the carrier, plural primer cords are used for detonation.

19 Claims, 11 Drawing Sheets

PERFORATING GUN WITH RETRIEVABLE MOUNTING STRIPS

BACKGROUND OF THE INVENTION

1. Field of the Invention

The present invention relates to through tubing perforation guns used to support explosive charges in a borehole to form perforations through which water, petroleum or minerals are produced.

2. Background Information

This invention is an improvement to prior art phased, through tubing, perforating system in that it allows for widely varied phasing (i.e., orientation of multiple directional charges at various angles) while allowing for retrieval of the carrier. Prior art phased capsule perforating systems may be generally classified into three categories: (1) the phased frangible base strip (U.S. Pat. No. 4,951,744); (2) the retrievable base strip with frangible retaining means (U.S. Pat. No. 5,095,999); and (3) the phased expendable link (U.S. Pat. No. 5,241,891).

The disadvantages of the first category (illustrated in FIG. 1 of the drawings) is that the shattered pieces of the base strip are not retrieved from the well leaving a substantial amount of debris. As a result, one cannot determine if all the charges detonated properly. Also, since the base strip shatters after firing the gun, the strip must be brittle and thereby could break when it is not desirable (e.g. upon conveying in the well).

The disadvantage of the second category (illustrated in FIG. 2 of the drawings) is that the base strip is composed of a heavy gauge steel bar that limits possible phasing (normally +45 degrees, –45 degrees) and that distorts (when the shaped charges are fired) to make retrieval difficult. Also, since only a relatively weak breakable clip retains the capsule charge to the base strip, it may break when it is undesirable (e.g. upon conveying into the well). The advantage of this system is that it permits some simple phasing (two rows at ±45 degrees typically), and the strip is rugged and retrievable.

The disadvantages of the third category (illustrated in FIG. 3 of the drawings) are that more debris is left in the well and that the system is weak (the pins and links often break when they hit obstructions in the tubing), resulting in use only for simple perforating operations. The main advantage of the third category is that very flexible phasing is possible. This high degree of phasing of the capsules is significant to well productivity in many formation types.

SUMMARY OF THE INVENTION

The general object of the invention is to provide a gun for well perforating that overcomes the various disadvantages of the prior art devices with a carrier having two or more nonfrangible, retrievable regions connected by a frangible region or seam that minimize the debris left in the well after perforation.

This object is achieved with a longitudinal carrier having one end adapted for mounting on a conveyance sub (head, etc), the carrier being nonplanar, with a slotted configuration and interior dimensions to enable capsule charge orientation at selected phases between 0 and 360 degrees. The carrier has a frangible seam that fractures upon detonation to form two retrievable strips, each supported by the conveyance sub for retrieval. The seam is a narrow bridge, formed by slotting the carrier partially, with a cross sectional area that shatters upon detonation of the shaped charges. The remaining cross sectional area and strength of each strip is sufficient to assure retrieval after detonation. The strips are preferably nonplanar, arcuate or a segment of a circle in cross section. When the capsule charges are arrayed around many phases, by attaching both front and rear portions of the capsule charges to the nonfrangible regions of the carrier, detonating cords are used for detonation.

The above as well as additional objects, features, and advantages of the invention will become apparent in the following detailed description.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
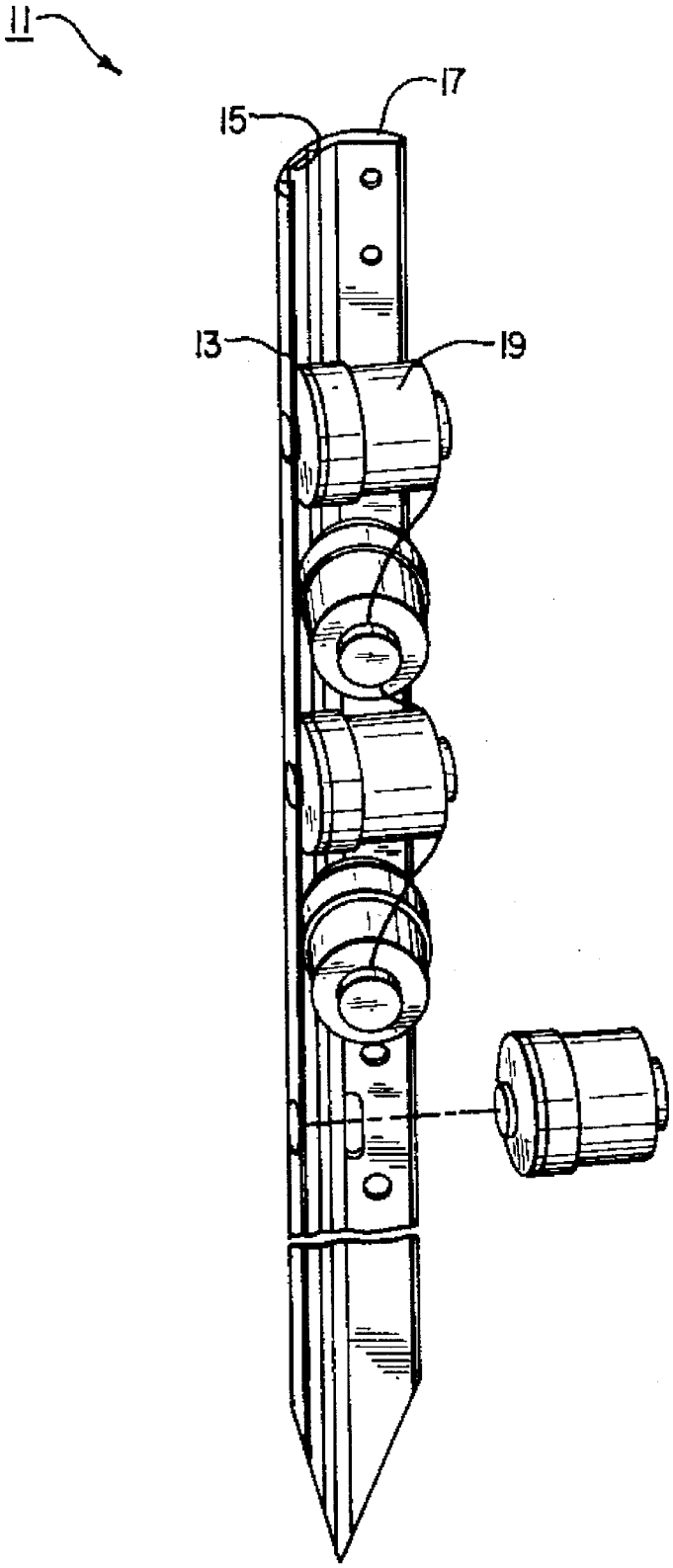
FIG. 1 (PRIOR ART)
FIG. 1 illustrates a prior perforating gun of the type that utilizes a frangible base strip.
Figure 2:
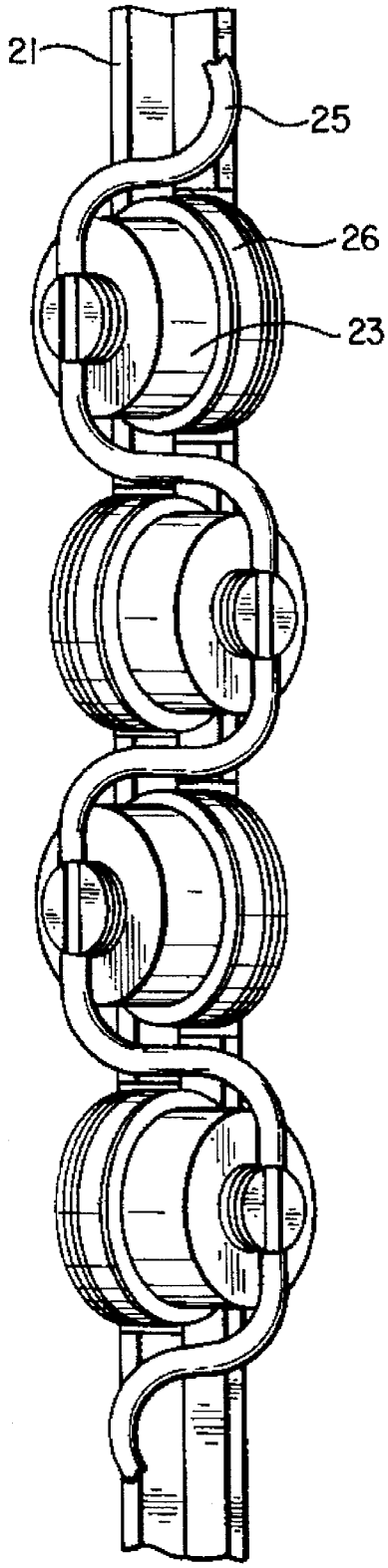
FIG. 2 (PRIOR ART)
FIG. 2 is a prior art perforating gun of the type utilizing a retrievable base strip with frangible retaining means.
Figure 3:
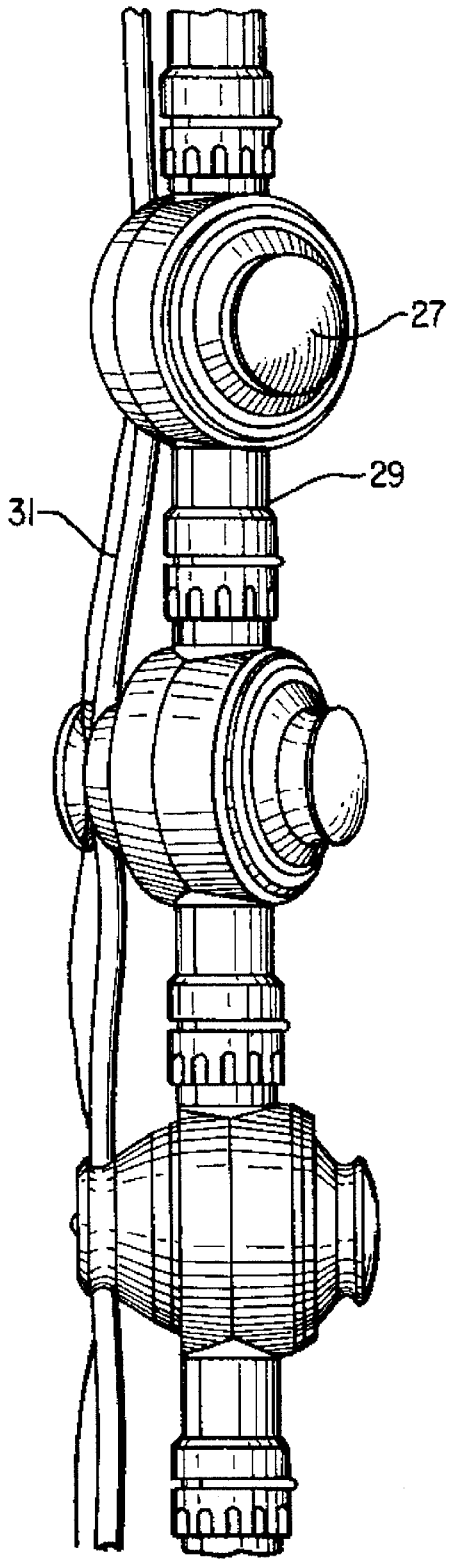
FIG. 3 (PRIOR ART)
FIG. 3 is a prior art perforating gun having multi phased expendable links.

Referring initially to FIGS. 1–3 of the drawings, which illustrate three prior art perforating guns, the perforating gun 11 of FIG. 1 utilizes a frangible base strip 13 having plural surfaces 15, 17 upon which are mounted a plurality of capsule charges 19 oriented at different angles or phases to perforate a well in more than one direction. The base strip 13 is constructed of a material as explained in the specification of U.S. Pat. No. 4,951,744 to shatter into a multitude of very small pieces in response to detonation of the capsule charges, allowing the resulting debris from the base strip to fall ideally below the perforating zone, to prevent obstruction of the flow of oil or gas from the perforated well. The material of the base strip 13 is strong enough to avoid breakage during impact with an obstruction when travelling downward in the borehole. A retrievable base strip that will not shatter when the charges detonate, and that may be retrieved from the well, is disclosed in U.S. Pat. No. 5,095,999. Here, the charges are retained on the base strip by support rings that will shatter into a multitude of pieces, allowing the charges to fall to the bottom of the well. This configuration of perforating gun is illustrated in FIG. 2 of the drawings and is taken from U.S. Pat. No. 5,095,999. A nonfrangible strip 21 is retrievable from the well after detonation of the capsule charges 23 upon ignition of the detonating cord 25. The capsule charges 23 are retained on the base strip 21 by a plurality of support rings 26 that shatter upon detonation of the capsule charges.

Another prior art perforating gun is shown in U.S. Pat. No. 5,241,891 and in FIG. 3, wherein the explosive charges 27 are mounted on link carriers 29, and are detonated by ignition of the detonating cord 31. This configuration of perforating gun occupies a small diameter similar to prior art guns in the well while enabling multi-phase orientation of the charges and retrieval from a well.

Figure 4:
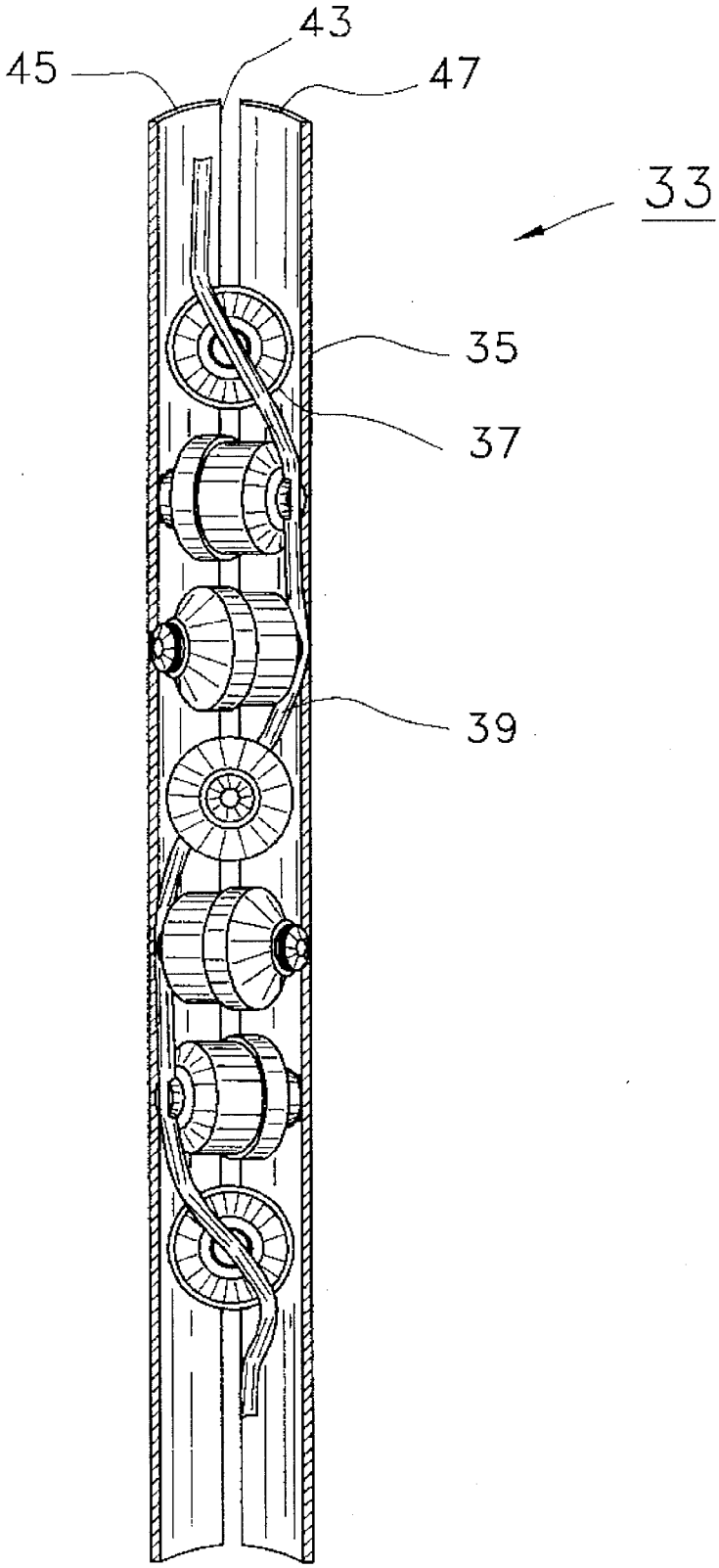
FIG. 4 illustrates the preferred embodiment of the present invention.
Figure 5:
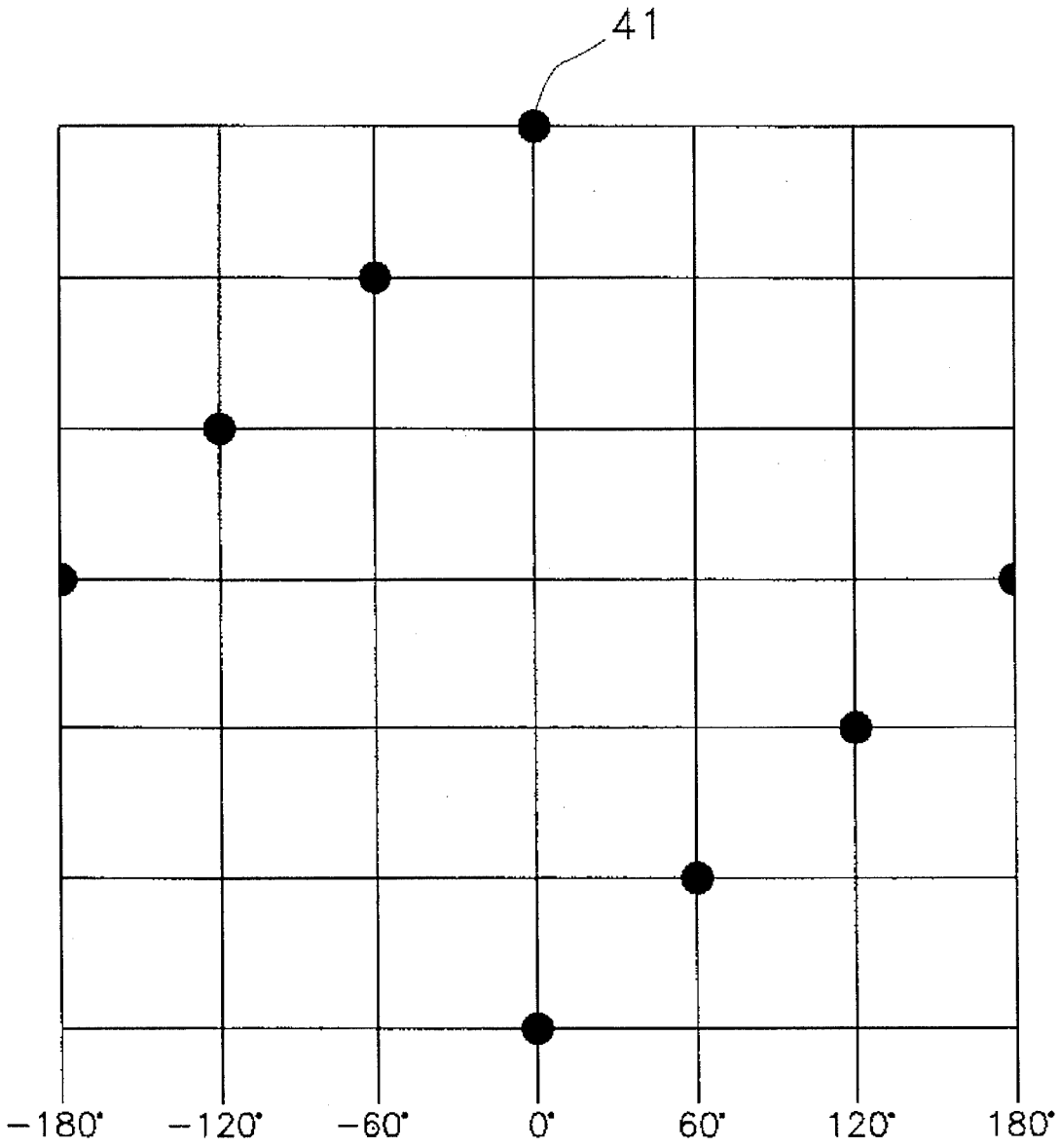
FIG. 5 is a phase diagram showing the angular orientation of the capsule charges in the FIG. 4 embodiment of the invention.
Figure 6:
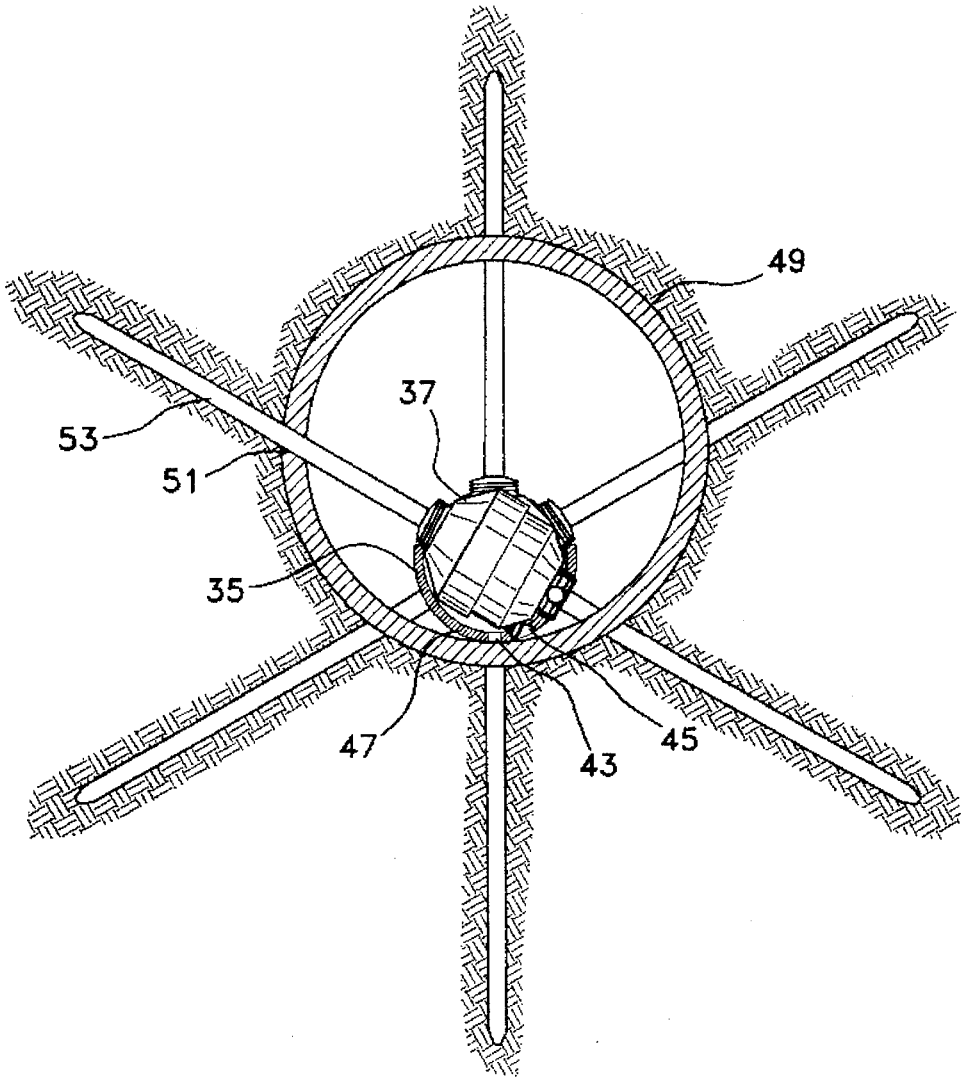
FIG. 6 is a view of the FIG. 4 embodiment shown from the top to illustrate the shaped charge orientations or phases and schematic representations of perforations extending through the casing and into a geological formation.

Referring now to FIG. 4 of the drawings and the preferred embodiment of the present invention, the numeral 33 designates a perforating gun for well perforating having a longitudinally slotted carrier 35 adapted to be mounted on a conveyance sub. The carrier 35 has interior dimensions to contain a plurality of capsule charges 37 that are detonated by ignition of the detonating cord 39 in the prior art manner. The capsule charges 37 of FIG. 4 are oriented to fire at 60 degree intervals, as indicated by the firing points 41 (FIG. 5). Thus, the FIG. 4 gun is adapted to fire at a selected phase of 60 degrees in a range extending from 0 to 360 degrees. The slotted carrier 35 has a slot 43 formed between two retrievable strips 45, 47. As shown in FIG. 6, when positioned in a well adjacent a casing 49 in a well to be perforated, the slotted carrier 35 will assume the position shown such that the capsule charges 37 fire in the indicated 60-degree phases to achieve a plurality of perforations 51, 53 in the casing and in a formation of the earth longitudinally along the axis of casing 49.

Figure 7:
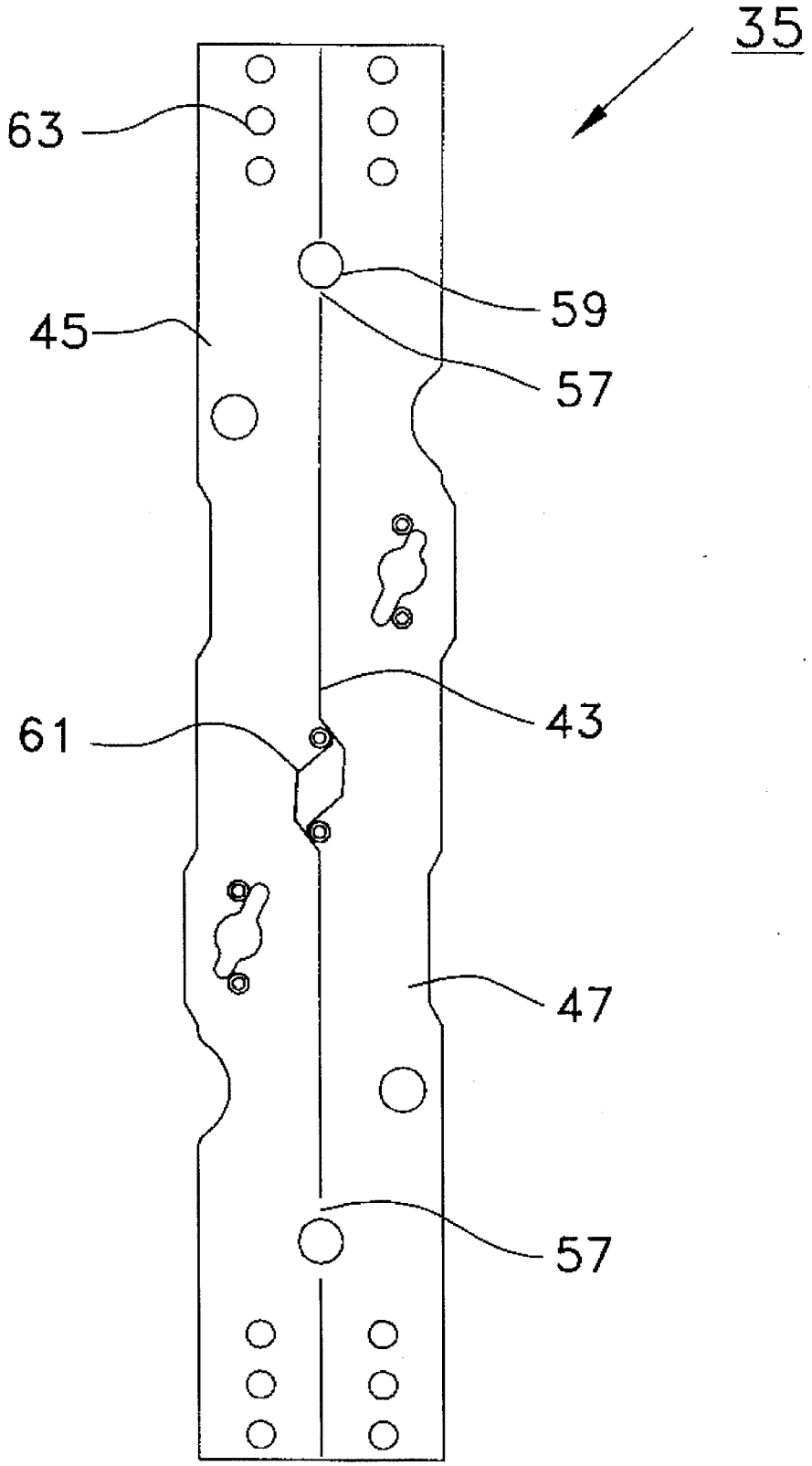
FIG. 7 is a schematic view of the carrier of FIG. 4 to illustrate the mounting means and slot configuration shown in the plane of the paper.
Figure 8:
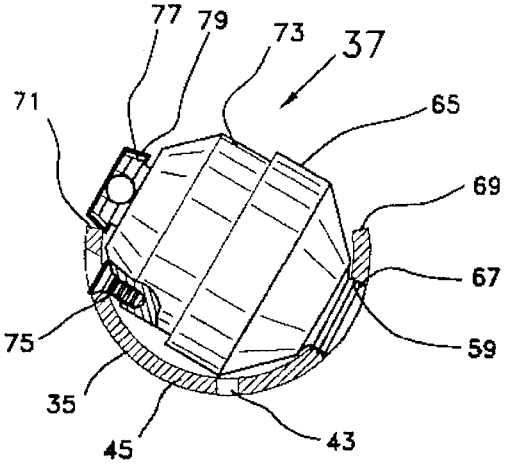
FIGS. 8–13 illustrate the carrier of FIG. 4, with each figure showing one capsule charge oriented according to the phase diagram of FIG. 5.
Figure 9:
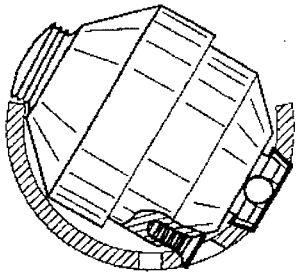
Figure 10:
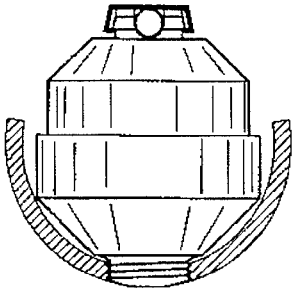
Figure 11:
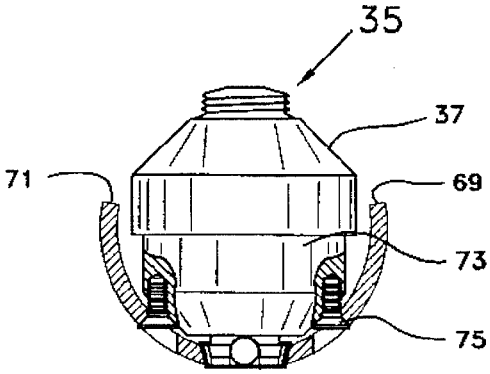
Figure 12:
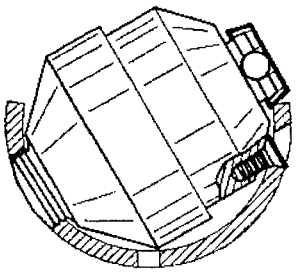
Figure 13:
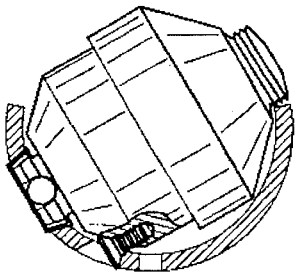
Figure 14:
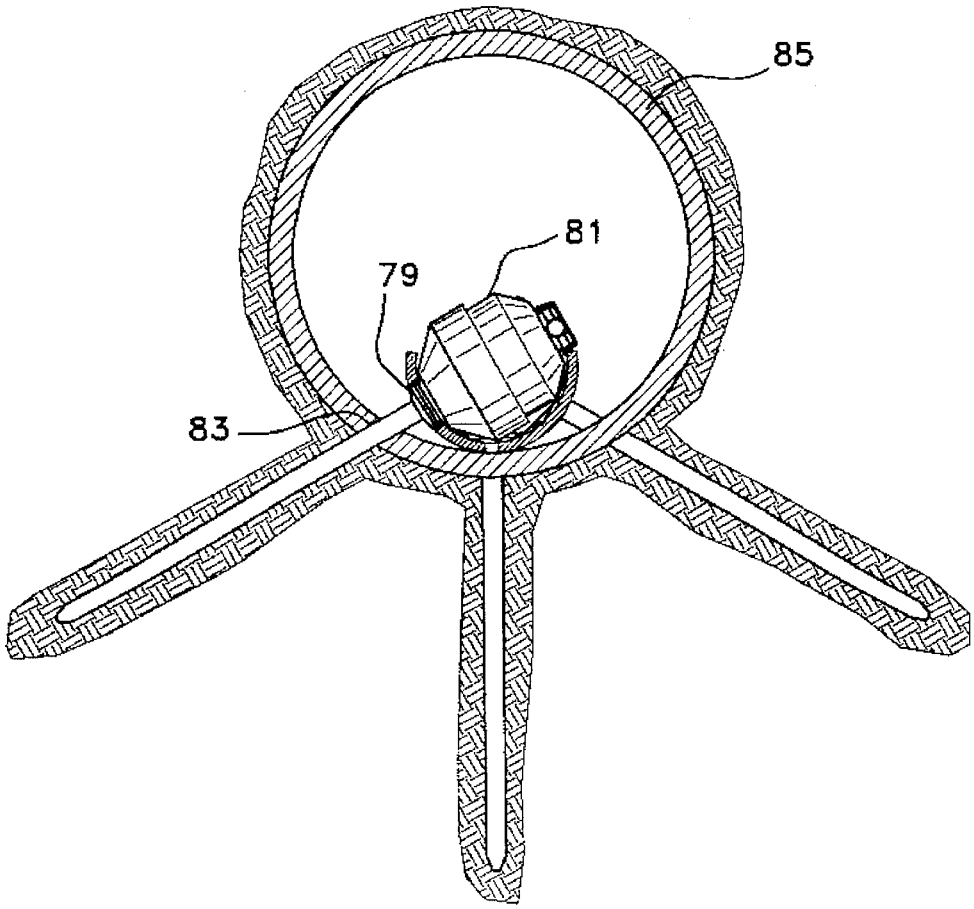
FIG. 14 illustrates an alternate embodiment of the invention with capsule charges oriented in 60 degree phases.

FIG. 7 illustrates the slotted carrier 35, unfolded into the plane of the paper, to show the preferred configuration of the strips 45, 47, slotted or divided longitudinally at 43 to form a series of bridges 57 adjacent a capsule front mount 59 or a capsule rear mount 61 to receive either the forward or rearward end of one of the capsules 37. The ends of the carrier 35 have a plurality of fastener receiving holes 63 for attachment to a conveyance top sub (not shown) or to another, similar carrier for added length.

The preferred manner of attachment of the capsule charges 37 is illustrated in FIGS. 8–13. Here, each capsule charge has a cap 65 threaded at 67 for attachment to one of the mounts 59 shown in FIG. 7, the mounts being similarly threaded. The carrier 35 is slotted at 43, and as shown in these cross-sectional views, is arcuate and more particularly a segment of a circle with ends 69, 71 that are about 200 degrees apart, thus exposing large portions of the capsule. Carrier 35 is nonplanar, meaning it is not in a plane but includes an angular strip of intersecting planes as well as arcuate or curved and segments or positions of a circle. For the purpose of achieving the previously described 60 degreee phasing for 360 degreees, some of the capsule charges 37 have cases 73 secured to the carrier by screws 75. A detonating cord (not shown) is inserted through each retainer 77 and retained with a clip 79.

As shown and as described above, the elongated carrier 35 and perforating gun 33 are lowered into a well (usually by wire line) until the explosive capsules 37 are positioned in the casing 49 adjacent the formation to be perforated. (See FIG. 6.) Upon ignition of the detonating cord 39 (FIG. 4), the capsule charges are detonated to create perforations in the 60 degree phase pattern shown in FIGS. 5 and 6, creating a plurality of perforations 51 in the casing and 53 in the formation. Detonation of the capsule charges 37 shatters or fractures the bridges 57 located between the slots 43 and the mounts 59 or 61. The cross-sectional area of each bridge 57 is selected to assure shattering or fracture upon detonation of the explosive capsule 37 and separation of the slotted carrier into two retrievable strips 45, 47. The capsule charges are of a prior art construction, made of a material to shatter into pieces small enough to fall to the bottom of the well. The carrier 35 made of a strong ductile and flexible material such as 1018 steel that can be inserted into a well on tubing and withdrawn from the well after detonation of the capsule charges 37 and the resulting deformation, to minimize the debris left in the well, by assuring return of the carrier.

Therefore, the carrier 35 is divided into at least two large nonfrangible flexible regions, in this embodiment strips 45, 47, each supported by a wire line firing head for retrieval from the well and each having mounts in selected regions to receive a capsule charge 37. The two nonfrangible regions 45, 47 are connected by a small frangible region, here a bridge 57, adjacent each of the mounts 59, 61. This bridge 57 allows the two regions 45, 47 to become the much stronger carrier 35. The frangible regions have a configuration to fracture upon detonation of the capsule charges or detonating cord 37 to form the two retrievable, nonfrangible regions, in this case two elongated strips.

The nonplanar configuration of the carrier 35 and its frangible regions 45, 47 enable orientation of the capsule charges in an array of selected phases, here 60 degreees, in a range from 0 to 360 degreees. In the preferred embodiment, each of the bridges has a cross-sectional configuration of 1/64 square inches, which satisfactorily shatters or fractures upon detonation of the capsule charge, a preferred form of which is known in the art as model No. "SHOGUN NT", manufactured by Owen Oil Tools, Inc. of Fort Worth, Tex.

Figure 15:
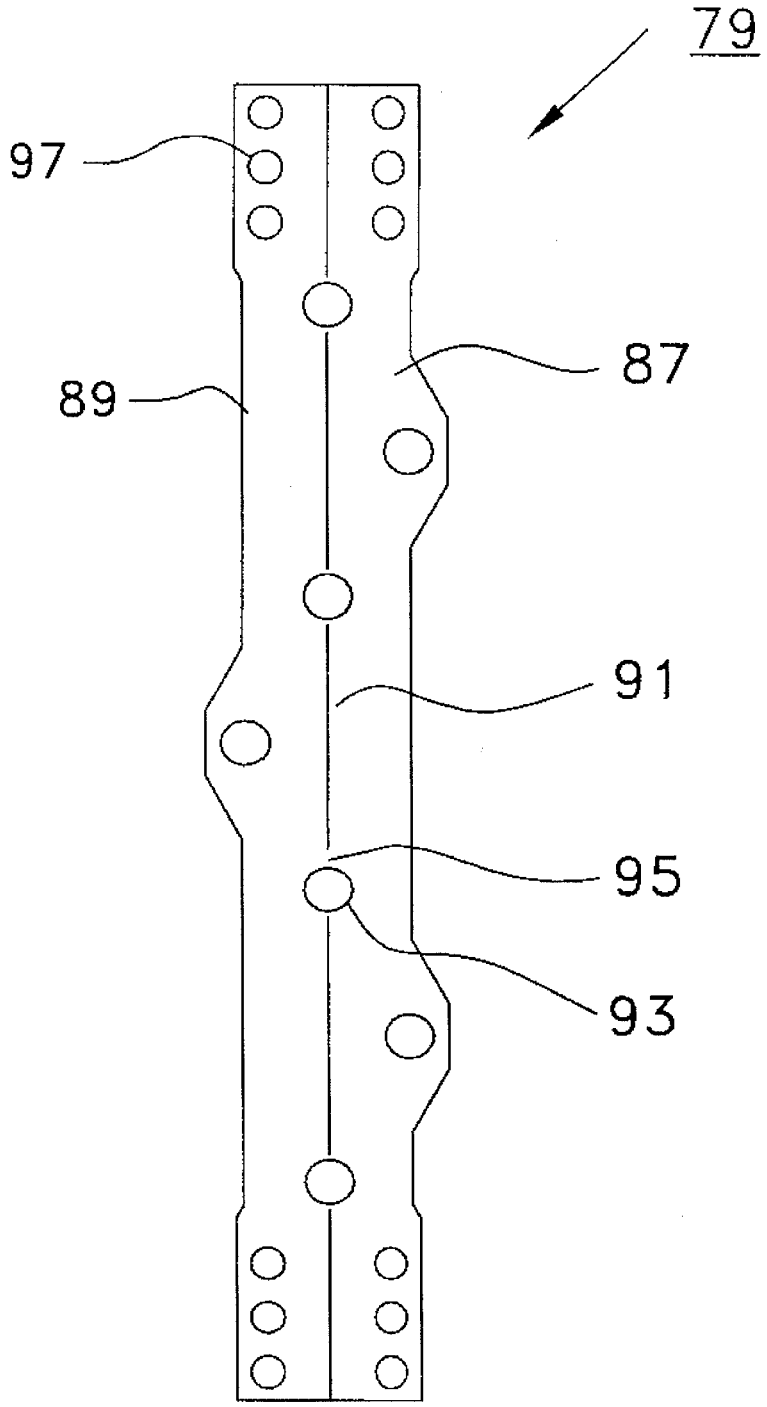
FIG. 15 is a schematic view of the carrier used in the FIG. 14 embodiment, illustrating the location of the capsule charge mounts; the slots and the bridges.
Figure 16:
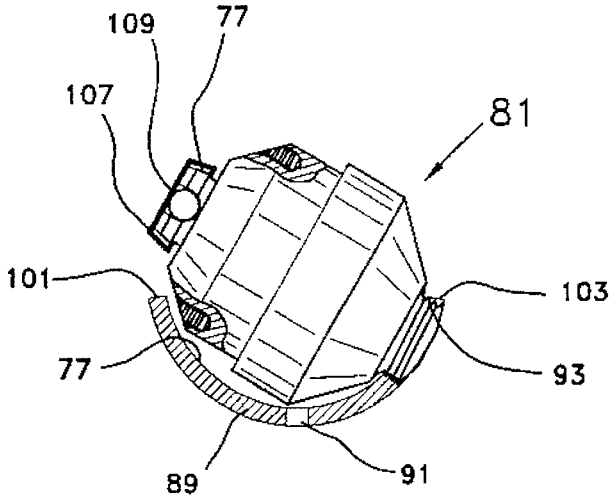
FIGS. 16–18 illustrate the orientation of the capsule charges in the carrier of FIG. 14.
Figure 17:
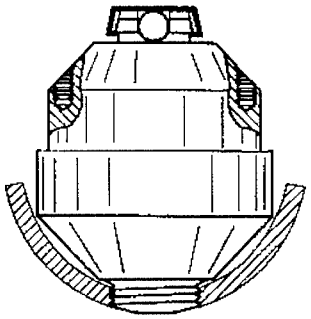
Figure 18:
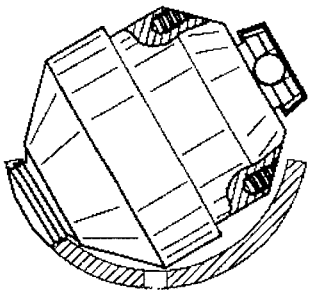

FIGS. 14–20 illustrate an alternate embodiment of the invention in which a slotted carrier 79 contains capsule charges 81 to create perforations 83 in a casing 85. As shown in FIG. 15, the carrier 79 is formed of two elongated, nonfrangible regions or strips 87, 89 separated by slot 91. A mount 93 is positioned adjacent each bridge 95 that has a configuration to fracture since it is a frangible seam that shatters or fractures upon detonation of the capsule charges 81. The longitudinal, retrievable strips 87, 89 each have fastener receiving apertures 97. Here, as in the previously described embodiment of the invention, the seam is a narrow bridge having a cross-sectional area to fracture or shatter upon detonation of the capsule charges. The carrier is nonplanar in the form of a segmented circle, with ends 101, 103 on a segment that is about 180 degrees. Since there are only three capsule charges in the array oriented at 60 degreee phasing, only the threaded cap 105 of each capsule is threaded into a mount 93. In this embodiment, the clip 107 is used to retain the detonating cord 109 to the capsule charge. As indicated in FIGS. 16–18, the selected phase in degrees is −60, 0 and +60.

It should be apparent to those having ordinary skill in the art that the invention has significant advantages. The use of nonfrangible strips to contain capsule charges, with the strips being joined by a frangible seam or region, enables insertion of the carrier into a well with little likelihood of damage severe enough to prevent successful detonation of the capsule charges and perforation of the well. After perforation, and because of the destruction during detonation of the frangible seams or bridges, the two carrier strips of which the carrier is composed may be successfully retrieved from the well, thereby minimizing the amount of debris left in the well. The use of a nonplanar carrier in the preferred form of a segment of a circle enables phase orientation in a selected range of 0 to 360 degreees.

It is important that a perforating gun be rugged, that is, it will not become stuck in the tubing during operation and the capsule charges will not separate from the base strip. If a gun is not rugged, and is broken or otherwise severely deformed during operation, it is possible that the live charges from the gun may become stuck in the tubing. Such charges must be recovered (salvaged) at considerable expense. During this salvage operation, there is a possibility that the charges will detonate at the incorrect depth in the well. A superior perforating gun system is one which: (1) upon detonation, penetrates the formation over a distance greater than the penetration distance associated with any other gun of the same diameter, (2) phases the charges in the gun in as many directions as possible and practical, (3) is rugged and durable enough to transverse the wellbore without fracturing or becoming stuck in the wellbore, (4) can be easily retrieved from the tubing without becoming struck due to the deformation that could be caused by the detonation of the charges, and (5) can be phased at a low enough angle to reduce the detonating cord travel distance, thereby reducing the possibility of explosive charge interference from nearby charges.

Our invention has the advantage of a maximum performance capsule charge together with a high degree of phasing, and easy retrieval through restrictions in the well. Even though a strip may be distorted due to charge detonations, the use of multiple strips allows for retrieval through a smaller restriction than would be possible with a single base strip. The base strip in manufactured is such a way as to break into two or more longitudinal strip pans after firing. The base strip can be manufactured from steel or other materials suitable for the application. The base strip can be manufactured from tubular materials, bent flat strip, or joined (e.g. welded) flat strips. After firing the system in the well, the base strip will break into at least two substantially longitudinal pieces that are still connected by a conveyance top sub for retrieval from the well. The flexibility offered by this invention allows a reduction in the detonating cord travel distance, thereby reducing the possibility of explosive charge interference. Angular phasing as low as 20 degrees is possible with this invention.

Although the invention has been described with reference to two specific embodiments, this description is not meant to be construed in a limiting sense. Various modifications of the disclosed embodiment as well as alternative embodiments of the invention will become apparent to persons skilled in the an upon reference to the description of the invention. It is therefore contemplated that the appended claims will cover any such modifications or embodiments that fall within the true scope of the invention.

We claim:

1. A perforating gun for carrying at least one explosive capsule to perforate a well, comprising:

an elongated carrier to be positioned in said well, the carrier being divided longitudinally into at least two strips with opposing edges connected by at least one bridge, each strip having an edge opposite the bridge and a size and a strength to be retrievable from the well after detonation of said explosive;

at least one opening in one of said strips to serve as a mount for the explosive, the opening being located in said strip a selected distance from the bridge and from the edge of said strip opposite the bridge;

the cross sectional area of the bridge being selected to assure shattering of the bridge upon detonation and separation of the carrier into at least said two strips for retrieval from the well bore; and the cross sectional area of said strip between said opening and said edge being selected to assure retrieval of the strip from the well after detonation of the explosive capsule.

2. The invention defined by claim 1 wherein said carrier and said strips are nonplanar, with at least one explosive charge being mounted on each strip.

3. The invention defined by claim 2 wherein said carrier and said strips are arcuate.

4. The invention defined by claim 3 wherein said carrier is substantially circular in cross section throughout its length.

5. A perforating gun conveyance in a well tubing and carrying a plurality of capsule charges, said gun comprising:

a carrier having one end adapted for positioning in a well adjacent a formation to be perforated;

the carrier being separable into at least two nonfrangible regions, each supported for retrieval from the well and each having a mount in a selected region to receive a capsule charge;

the two fangible regions being connected by a frangible region adjacent one of the mounts;

the frangible region having a configuration to fracture upon detonation and separate the carrier into said two retrievable nonfrangible regions.

6. The invention defined by claim 5 wherein the carrier is longitudinally slotted to form said two nonfrangible regions.

7. The invention defined by claim 6 wherein said nonfrangible regions of the carrier are portions of a tube that is arcuate in cross section.

8. The invention defined by claim 7 wherein said tube has inner and outer surfaced that are each a segment of a circle.

9. A perforating gun for mounting on a conveyance sub and carrying a plurality of capsule charges of selected maximum outside dimension to perforate a well, said gun comprising:

a longitudinally slotted carrier having one end adapted for positioning in a well adjacent a formation to be perforated;

the carrier having a nonplanar, longitudinally slotted body with inner and outer surfaces, with an inner dimension larger than said maximum outside dimension of said capsule charges, thereby enabling orientation of said capsule charge and attachment to said carrier at selected phases in a range between 0 and 360 degrees;

the carrier having two strips joined by a frangible seam to fracture upon detonation of said capsule charges to separate said strips, each strip being supported by the conveyance sub for retrieval from the well.

10. The invention defined by claim 9 wherein the seam is a narrow bridge between said strips.

11. The invention defined by claim 9 said capsule charges are elongated, have fronts and rears and are selectively adapted for mounting by the front or the rear to the carrier.

12. The invention defined by claim 11 wherein each strip is a portion of a tube that is arcuate in cross section.

13. The invention defined by claim 12 wherein said tube has inner and outer surfaces that are each a segment of a circle.

14. The invention defined by claim 9 wherein one of the selected phases is 60 degrees.

15. The invention defined by claim 9 wherein the selected phases comprises −60, 0, +60, 0 degrees.

16. The invention defined by claim 11 wherein the fronts of said selected capsule charges are in the form of a threaded protrusion and said strips have receiving, threaded apertures to receive said threaded protrusions.

17. The invention defined by claim 16 wherein selected capsule charges have rearward portions secured to said carrier sleeve.

18. The invention defined by claim 17 which further comprises two detonating cords to minimize the length of cord between capsule charges.

19. The invention of claim 9 where the carrier contains at least three shaped charges mounted for firing at different angles.

* * * * *